US008245658B2

(12) United States Patent
Holland et al.

(10) Patent No.: US 8,245,658 B2
(45) Date of Patent: Aug. 21, 2012

(54) SYSTEMS AND METHODS FOR SUPPORTING TANKS IN A CARGO SHIP

(75) Inventors: John Randolph Holland, Schwanewede (DE); Wolfgang Fichelmann, Zeuthen (DE); Juergen Wollert, Arnis (DE)

(73) Assignee: John Randolph Holland, Schwanewede (DE)

( * ) Notice: Subject to any disclaimer, the term of this patent is extended or adjusted under 35 U.S.C. 154(b) by 268 days.

(21) Appl. No.: 12/484,772

(22) Filed: Jun. 15, 2009

(65) Prior Publication Data

US 2010/0012014 A1 Jan. 21, 2010

Related U.S. Application Data

(60) Provisional application No. 61/129,639, filed on Jul. 9, 2008.

(51) Int. Cl.

| | |
|---|---|
| ***B63B 25/12*** | (2006.01) |
| ***B63B 25/14*** | (2006.01) |
| ***B63B 25/16*** | (2006.01) |
| ***B63B 17/00*** | (2006.01) |
| ***B63B 3/70*** | (2006.01) |
| ***B65D 90/12*** | (2006.01) |
| ***F17C 13/08*** | (2006.01) |

(52) U.S. Cl. ..... 114/74 R; 220/560.07; 220/560.11; 220/628; 220/901

(58) Field of Classification Search ..... 114/74 R–74 A; 220/560.05, 560.07, 560.09, 560.11, 560.12, 220/562, 628, 633, 635, 901

See application file for complete search history.

(56) References Cited

U.S. PATENT DOCUMENTS

| | | | | |
|---|---|---|---|---|
| 1,634,084 | A * | 6/1927 | Ruths | 248/146 |
| 2,706,575 | A * | 4/1955 | Soherr | 220/560.1 |
| 3,899,988 | A * | 8/1975 | Menendez | 114/74 A |
| 3,908,574 | A | 9/1975 | Miller et al. | |
| 4,086,864 | A | 5/1978 | Ito | |
| 4,099,649 | A * | 7/1978 | Guilhem et al. | 220/560.07 |
| 4,128,070 | A * | 12/1978 | Shadid et al. | 114/74 A |
| 4,345,861 | A * | 8/1982 | Aarseth | 410/68 |

FOREIGN PATENT DOCUMENTS

| | | | |
|---|---|---|---|
| FR | 2711965 | A1 * | 5/1995 |
| JP | 56-095787 | | 8/1981 |

(Continued)

OTHER PUBLICATIONS

International Search Report and the Written Opinion issued for PCT/US2009/049894, dated Sep. 3, 2010, 11 pages.

(Continued)

*Primary Examiner* — Ajay Vasudeva

(74) *Attorney, Agent, or Firm* — Fulbright & Jaworski L.L.P.

(57) ABSTRACT

There are disclosed systems and methods for supporting cargo tanks within the hold of a liquefied gas carrier by establishing a series of spaced-apart pedestals along the longitudinal axis of a tank, said pedestals positioned in conjunction with the ship's structural components. These pedestals are of wood or other suitable thermal insulating and load bearing material fixed to the tank below its circumferential diameter along both the starboard and port tank sides. The pedestals rest on structural longitudinal stringers laying port and starboard in the horizontal plane and fixed and supported by the ship's hull structure. Longitudinal and transverse pedestal movement is controlled by stops attached to the stringers at one or more of the pedestals. The stops contact the pedestals via bearing pads which constrain the pedestal in one direction but permit its movement in another.

10 Claims, 10 Drawing Sheets

FOREIGN PATENT DOCUMENTS

| | | | |
|---|---|---|---|
| JP | 02-085600 | | 3/1990 |
| JP | 06-337100 | | 12/1994 |
| JP | 08058676 A | * | 3/1996 |
| JP | 09-133297 | | 5/1997 |

OTHER PUBLICATIONS

Office Action issued for Japanese Patent Application No. 2011-517557, dated Jun. 14, 2012, 5 pages, with English language translation.

* cited by examiner

SYSTEMS AND METHODS FOR SUPPORTING TANKS IN A CARGO SHIP

CROSS-REFERENCE TO RELATED APPLICATIONS

This application claims priority to Provisional Patent Application Ser. No. 61/129,639 filed Jul. 9, 2008 entitled SUPPORT SYSTEM FOR CYLINDRICAL CARGO TANKS CONTAINING LIQUEFIED BULK GAS IN MARINE APPLICATIONS, which application is hereby incorporated by reference herein.

TECHNICAL FIELD

This disclosure relates generally to a support system for independent cargo tanks containing liquefied gases and is particularly useful in enabling large diameter cryogenic tanks to be safely installed and operated on liquefied gas carriers.

BACKGROUND OF THE INVENTION

It is now common to transport liquefied gases and other materials in tanks positioned within the holds of cargo ships. Particularly, it is well known that liquefied gases, such as LPG, ethylene and LNG, can be transported in tanks permanently attached within the holds of a cargo ship.

The design and construction of liquefied gas carriers is regulated by the International Maritime Organization (IMO) primarily through application of the International Gas Carrier Code (IGC Code). The IGC Code permits a wide range of cargo containment systems. The cylindrical tank system is the most widely employed containment system for liquefied gas carriers having capacities below approx. 22,000 $m^3$. With this system, the cylindrical tanks are supported by two transverse saddles located one near each end of the cylindrical tank. The tank has an internal ring frame at each saddle to help stabilize and distribute the saddle loads into the tank shell. The two saddle system minimizes interaction and resulting stresses between the hull and the tank both of which flex under forces imposed by the ship motions. The diameter and length of such tanks are limited by technical and economic constraints such that the largest single tank known to have been constructed to date has a capacity of about 6,000 $m^3$ and the largest ship capacity is believed to be approximately 12,000 $m^3$.

Larger liquefied gas carriers employ either two smaller diameter tanks fitted side by side or a so called bilobe tank. The bilobe tank consists of two parallel, same diameter horizontal cylinders intersecting each other at about 80% of their diameter. An internal longitudinal bulkhead is fitted where the two "lobes" are joined. As with the cylindrical tank, the bilobe tank is supported by two saddles one near each end. Such tanks can be built to diameters of around 15 m. The largest such tank known to have been built to date is about 7,500 $m^3$ and the largest such liquefied gas carrier employing bilobe tanks has a capacity of around 22,000 $m^3$. Currently, there are studies underway for larger carriers in the range of 40,000 $m^3$.

The interaction between tank and hull due to deformation of each is complex and limits the number of support points to two. The diameter of such tanks is practically limited by the density of the cargo, the design pressure of the tank, saddle spacing, fabrication restrictions and economic factors.

The limitation of two support saddles for each tank results in very large, highly concentrated loads being imposed on the ship's bottom structure. Such "point" loads can exceed 25% of the total loaded ship's displacement (weight in water). These concentrated loads must therefore be distributed throughout the hull structure by way of a complex system of girders and grillage. Such hulls are difficult to fabricate and require more steel than a hull where the cargo load is evenly distributed along the ship's length.

Both of the above tank types are designed as Type C tanks in accordance with the IGC code. Type C tanks are generally designed to comply with land-based pressure vessel codes such as ASME Div. VIII. However, due to the dynamic loads such tanks are subjected to at sea, the IGC Code requires liquefied gas carrier tanks to be designed to increased design pressures, acceleration forces and safety factors as compared to land-based tanks. Therefore Type C tanks are often designed to pressures and loads considerably higher than they will actually experience during their lifetime. This results in large shell material thickness, high tank weight and excessive cost. Since most liquefied gases are carried at atmospheric pressure, the Type C tank is a disadvantage in weight and cost.

Spherical tanks are also used to transport liquefied gases, usually liquefied natural gas at −162° C. Such tanks are designed as Type B tanks of the IGC Code. Type B permits the tanks to be designed to pressures, accelerations and fatigue life as may be actually experienced by the ship during its lifetime. Determining the actual expected design loads is a time consuming and expensive process, but such tanks may be designed with lower material thickness and weight compared to a Type C tank. However, spherical tanks are expensive to fabricate and are generally used only in large liquefied natural gas (LNG) carriers. The largest tanks built to date have a diameter of about 43 m and a volume of around 40,000 $m^3$. In addition to the cost disadvantage, spherical tanks do not utilize the available space in the ship's cargo hold as well as cylindrical tanks and therefore a larger ship must be designed to obtain the same transport capacity.

Independent prismatic tanks are constructed primarily of flat surfaces which are shaped to utilize the ship's form to the greatest possible extent. These tanks may be either Type B tanks or Type A tanks. Type A tanks require the surrounding ship's hull structure to act as a secondary liquid barrier as a protection should the primary liquefied gas tank leak or fail. The surrounding ship's hull structure must therefore be constructed of expensive, low temperature steel which remains tough and crack resistant at the boiling temperature of the liquefied gas (usually LPG, propane or ammonia). Type B prismatic tanks do not need a full secondary barrier and therefore the hull can be built largely of normal ship steel. As with the Type B spherical tank, considerable detailed stress analysis is required to minimize the risk of fatigue or crack propagation. Both tank types have considerable internal support structure similar to the internal hull structure of an oil tanker. Although prismatic tanks have a better volumetric efficiency in the hull than do cylindrical or spherical tanks, they require considerably more material and have limited design pressure.

In case of flooding of the cargo hold by grounding or collision, the cargo tank must be prevented from floating up and breaking through the upper part of the cargo hold. With conventional Type C tanks this is normally accomplished by four large brackets placed on the upper side of the tank in way of the two ring frames. The floatation load is then transmitted through the brackets to the upper hull sides. With spherical tanks, the tank equator is welded to the ship's structure via a so called skirt and therefore the support structure also holds the tank against floatation. With prismatic tanks the hold down is accomplished by brackets located on the upper sides of the tanks and attached to the sides of the ship in numerous locations.

BRIEF SUMMARY OF THE INVENTION

There are disclosed systems and methods for supporting cargo tanks within the hold of a liquefied gas carrier by establishing a series of spaced-apart pedestals along the longitudinal axis of a tank, said pedestals positioned in conjunction with the ship's structural components. These pedestals are of wood or other suitable thermal insulating and load bearing material fixed to the tank below its circumferential diameter along both the starboard and port tank sides. The pedestals rest on structural longitudinal stringers laying port and starboard in the horizontal plane and fixed and supported by the ship's hull structure. Longitudinal and transverse pedestal movement is controlled by stops attached to the stringers at one or more of the pedestals. The stops contact the pedestals via bearing pads which constrain the pedestal in one direction but permit its movement in another. The bearing pads reduce the friction between pedestal and stop thereby allowing free movement in the desired direction.

In this manner, cylindrical cargo tanks having the weight and material thickness advantages of Type B cargo tanks plus the fabrication advantages of cylindrical Type C tanks can provide better utilization of the cargo space than spherical tanks and reduced material and fabrication cost of prismatic or Type C tanks. Additionally, the spaced-apart pedestals promote even distribution of loads from the tank or tanks into the ship's hull structure thereby enabling a simpler and lighter hull structure while also eliminating excessive hull deflections and reducing sensitivity due to sloshing loads. The design of the pedestals, stops and bearing pads minimize thermal heat transfer and allow for normal cargo tank and hull deflections without adverse affects. Single tank capacities of 15,000 $m^3$ or more may be realized with the concepts discussed herein.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Figure 1:
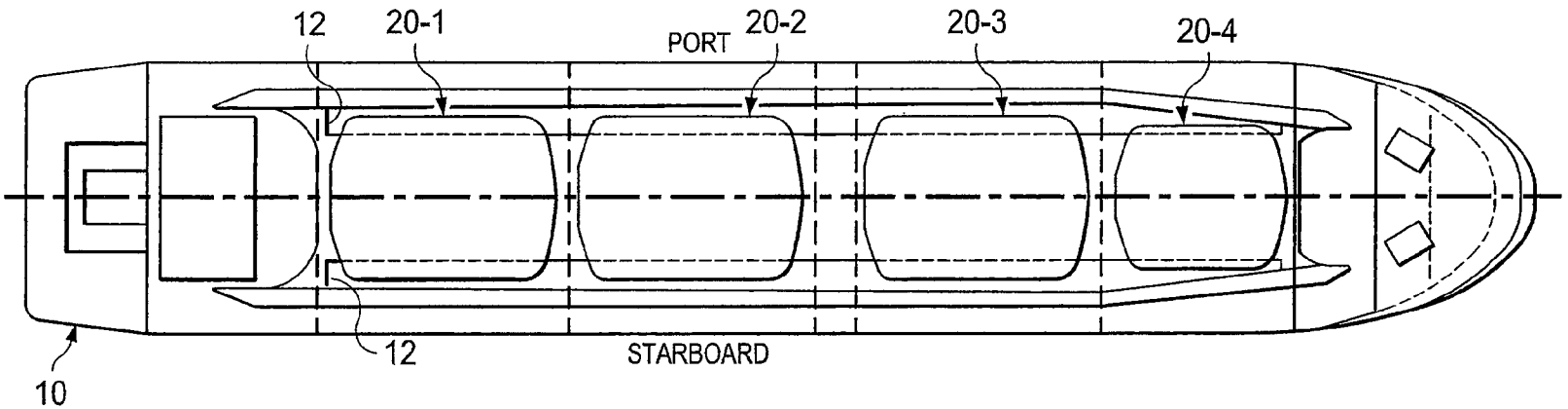
FIG. 1 shows a top view of a liquefied gas carrier having a tank arrangement therein.

FIG. 1 shows a top view of liquefied gas carrier 10, having cargo tanks 20-1 though 20-4 arranged therein. Note that while the cargo tanks are shown in a straight line displaced along the longitudinal axis of the ship, the concepts discussed herein can be used with any placement of tanks and with any number of tanks.

Figure 2:
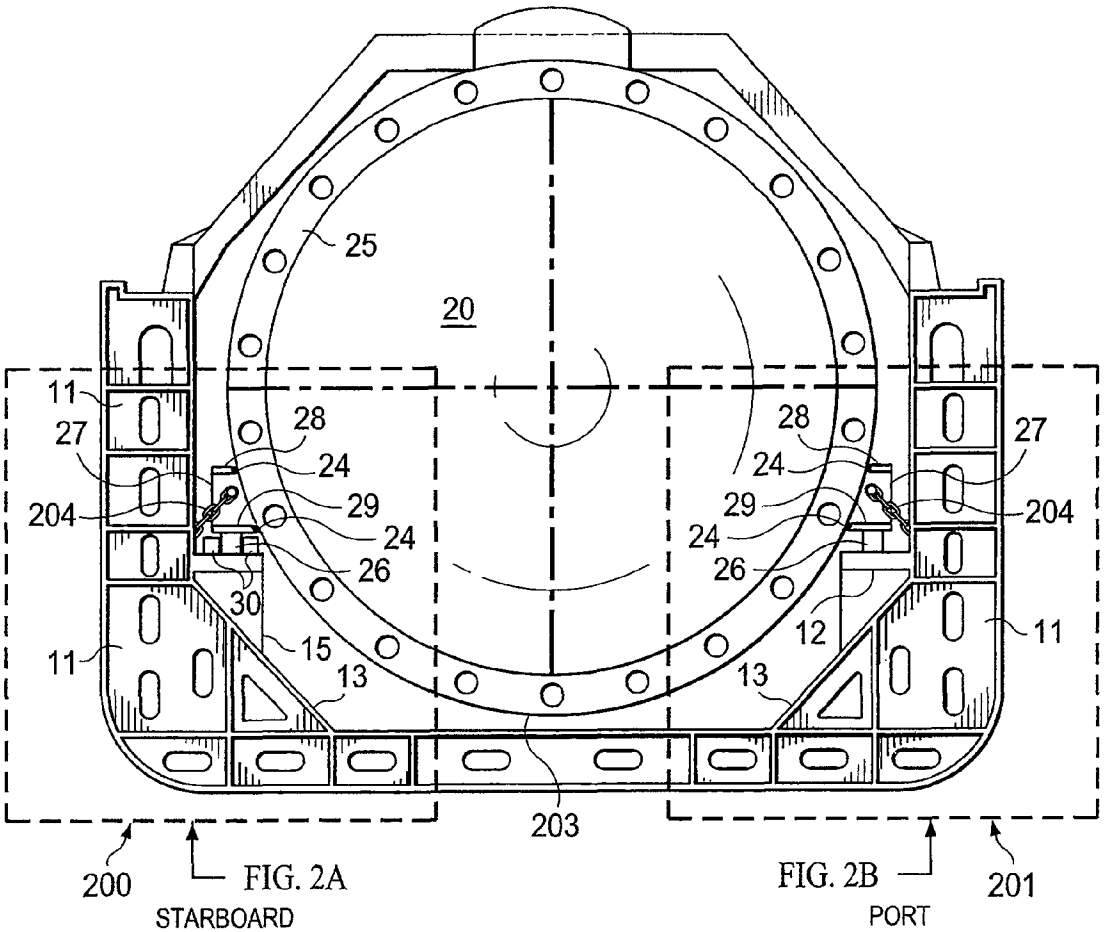
FIG. 2 shows a cross section of a cargo tank, looking towards the aft, being supported by the system and method described herein.
Figure 2A:
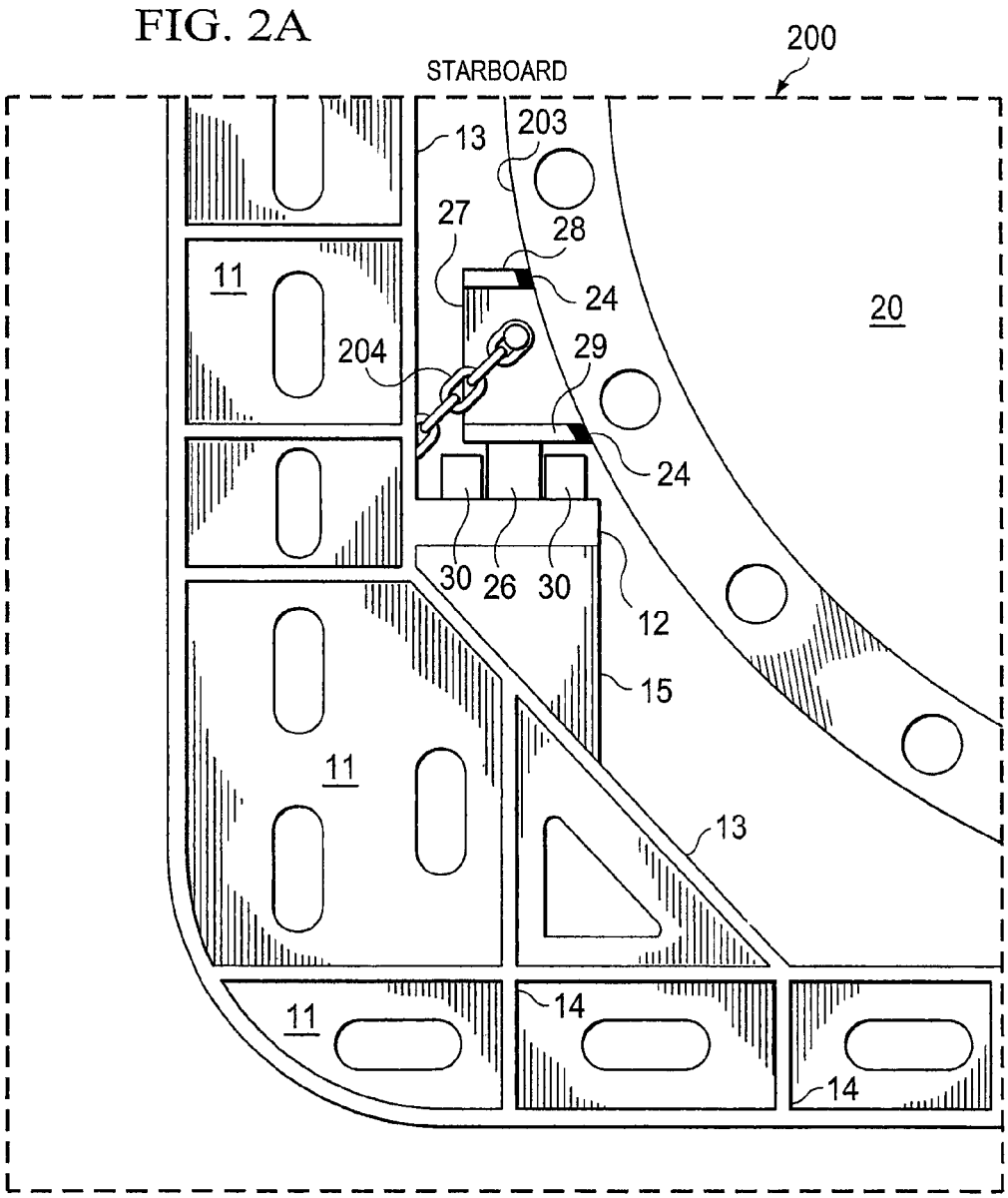
FIGS. 2A and 2B show expanded views of the starboard and port, respectively supports.
Figure 2B:
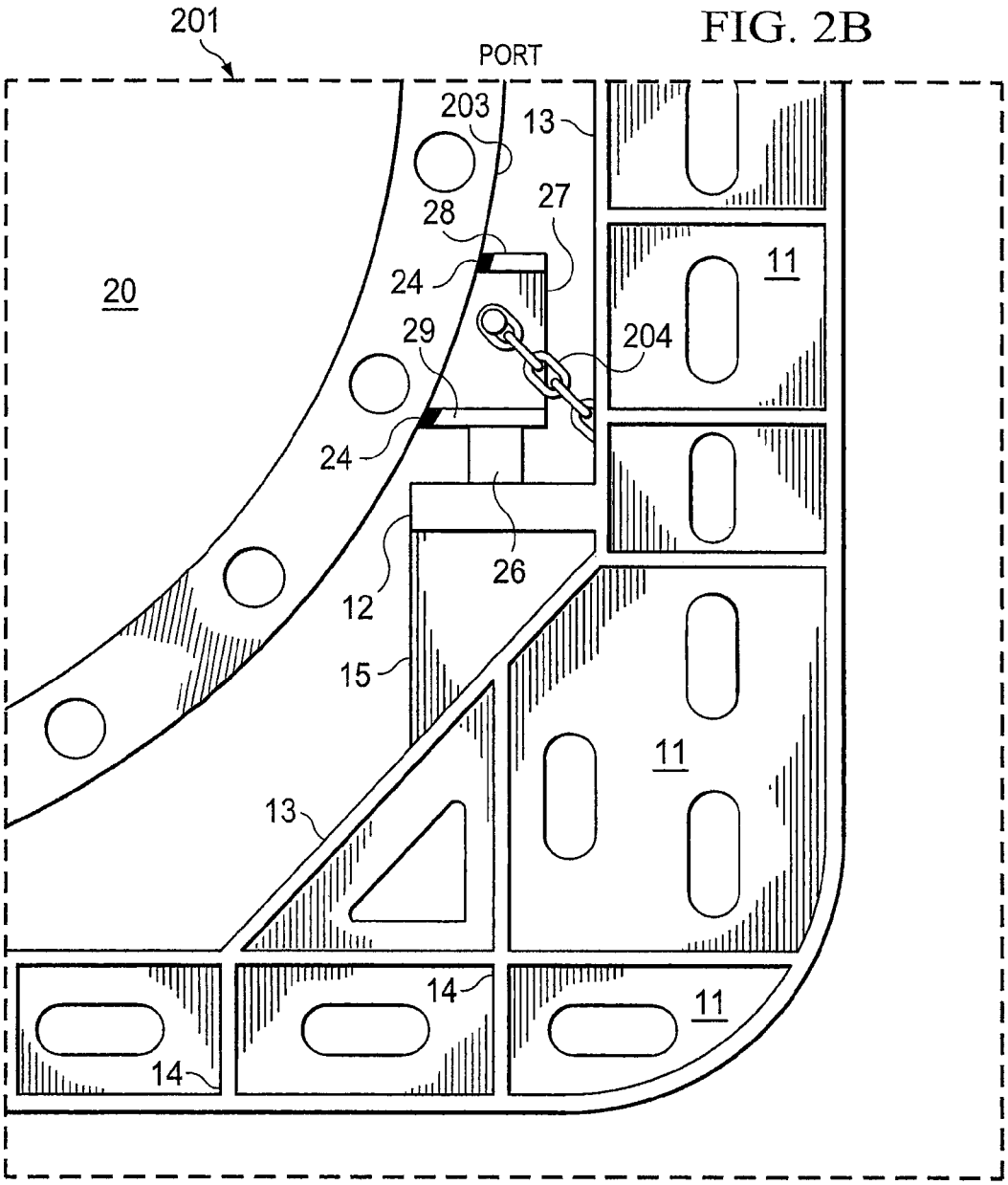

FIG. 2 shows a cross-section of tank 20 being supported by the system and method described herein. In order to facilitate the support system of this invention it is advantageous to add a support structure, such as the longitudinal stringer 12 which is integrated into the ship's hull structure comprised of transverse web frames 11 and longitudinal bulkheads 13 or girders 14, as shown in FIGS. 2A and 2B. Note that while structures 12, 13 and 14 are preferably continuous structures they can be discontinuous and placed only where necessary.

Figure 5A:
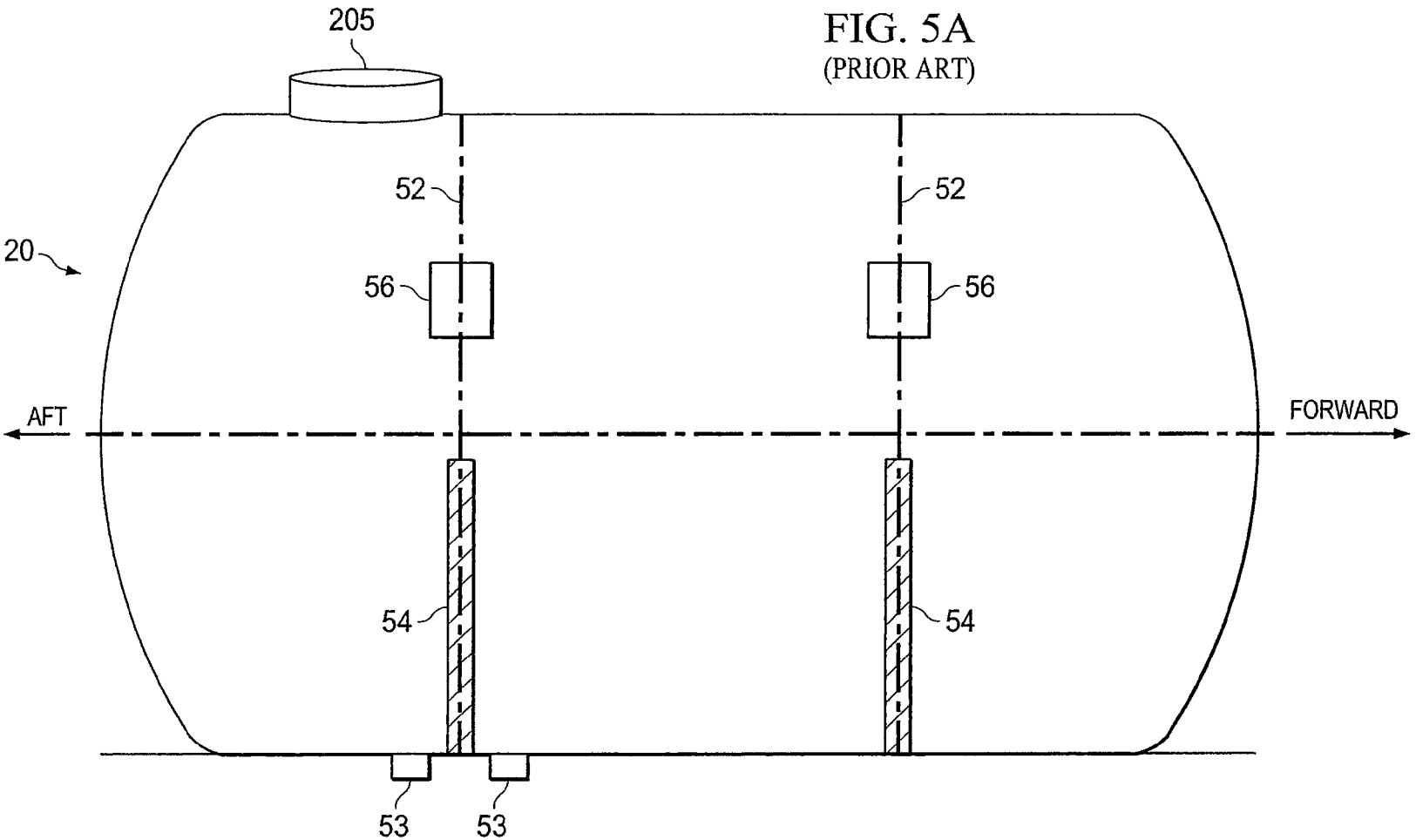
FIG. 5A (PRIOR ART)
FIGS. 5A and 5B show an example of a cylindrical Type C tank with prior art support arrangement for use in liquefied gas carriers.
Figure 5B:
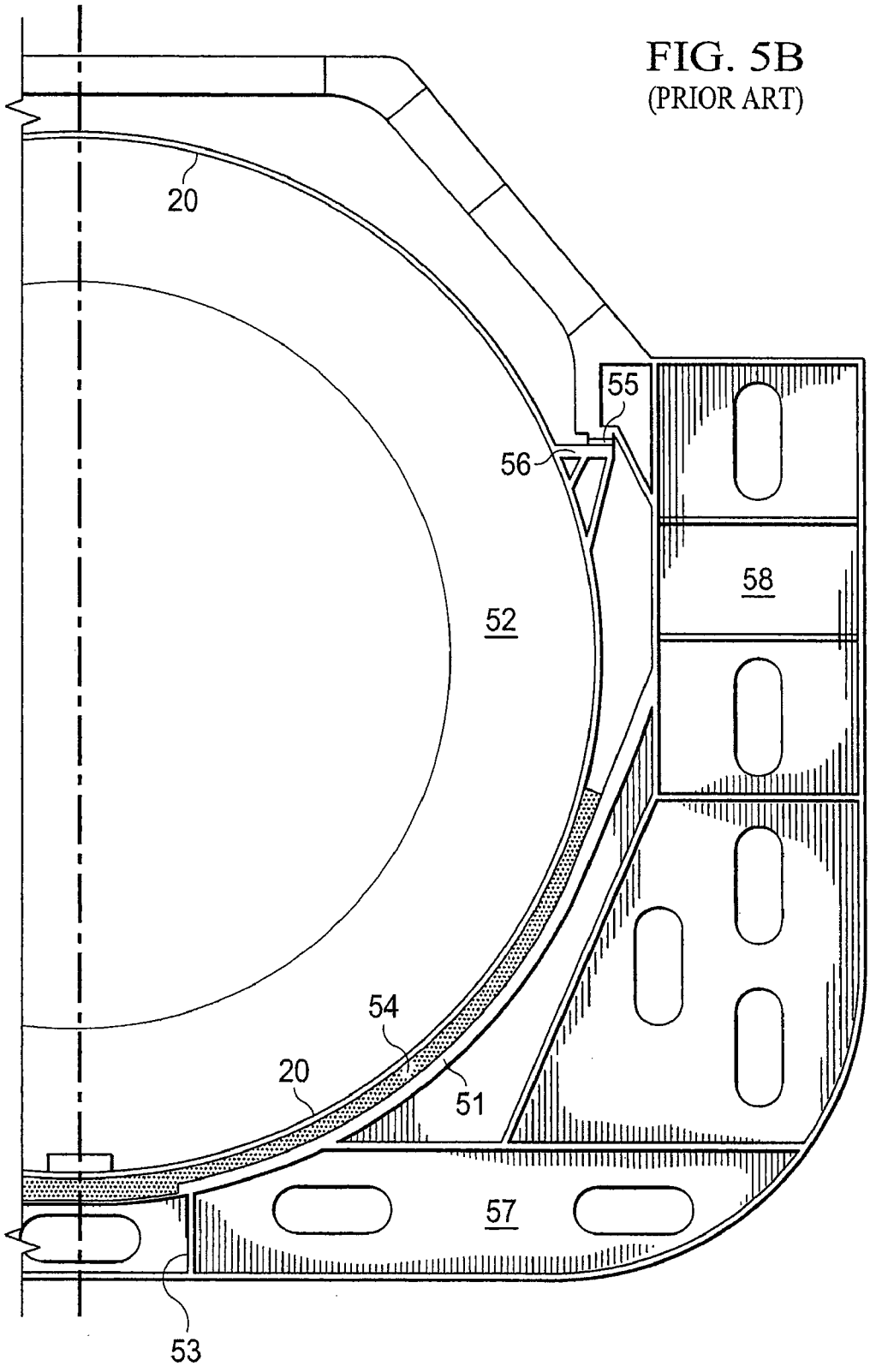
FIG. 5B (PRIOR ART)

Before discussing the inventive concepts of this invention it might be helpful to review a prior art support structure as shown with respect to FIGS. 5A and 5B. As shown in FIG. 5A, cylindrical tank 20 is supported internally by ring frame 52.

In FIG. 5B, transverse saddle 51 is supported by the ship's bottom 57 and side hull 58. Typically, there is wood bearing 54 between the tank and the steel saddle. At each ring frame 52, a hold down bracket 56 is attached to the shell. Hold down bracket 56 presses against the ship's side hull 58 with stopper 55 to prevent floating of the tank. Hold down bracket 56 is on the port and starboard sides of the tank. There is longitudinal stop 53 at the bottom of one end of the tank. Except for the longitudinal stop, this same structure is repeated at the other end of tank 20 as shown in FIG. 5A. Each saddle carries approximately 50% of the static tank load and this load can nearly double due to ship motions. Under such loads, both the hull and tank will deflect considerably in a complex interaction thereby increasing stresses in both the cargo tank and the support structure. To prevent structural failure, a heavy and complex support structure must be designed using detailed structural analysis.

Figure 3:
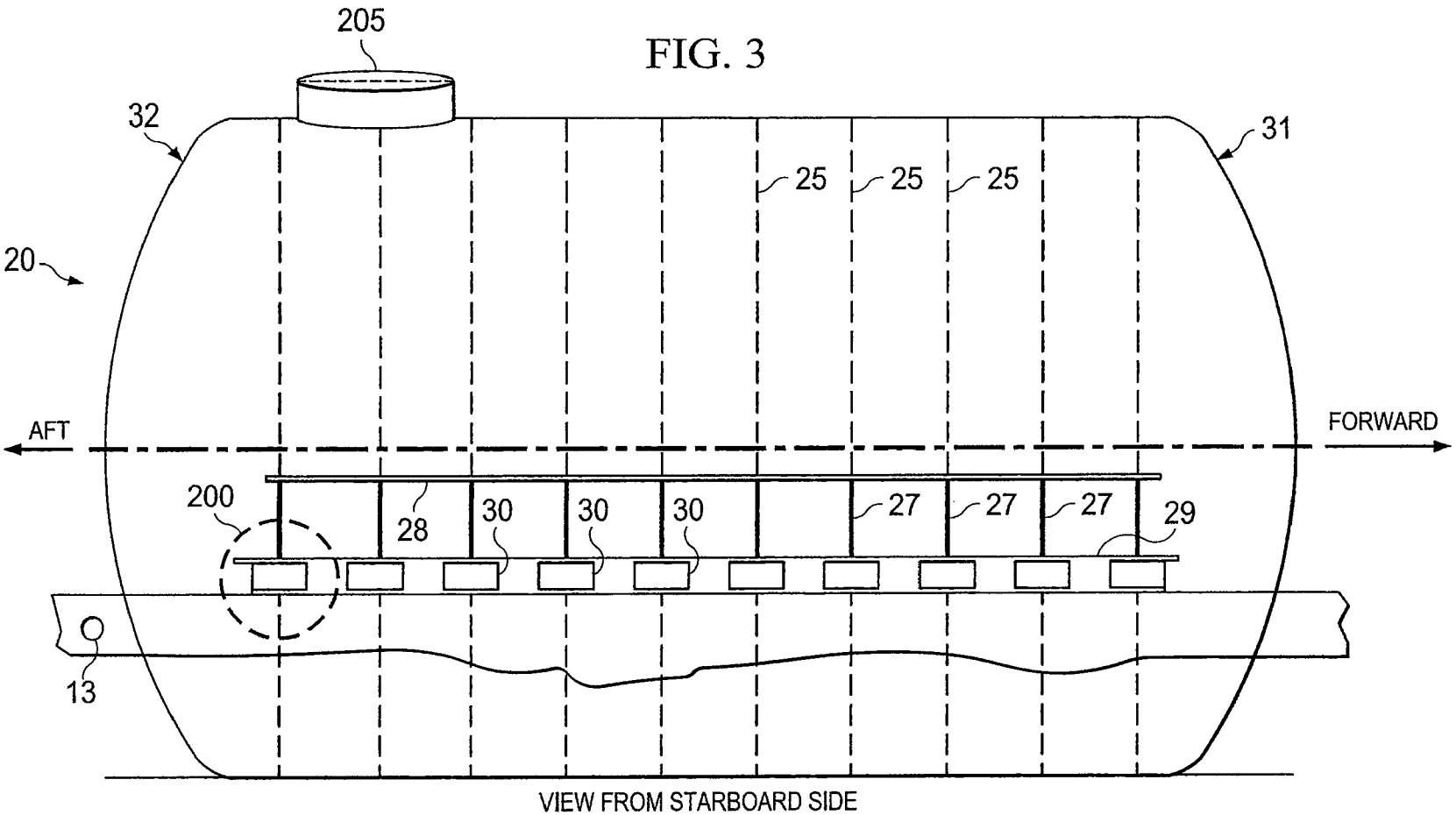
FIGS. 3 and 4 are side and top views, respectively, of a cargo tank being supported by the system and method described herein.
Figure 6:
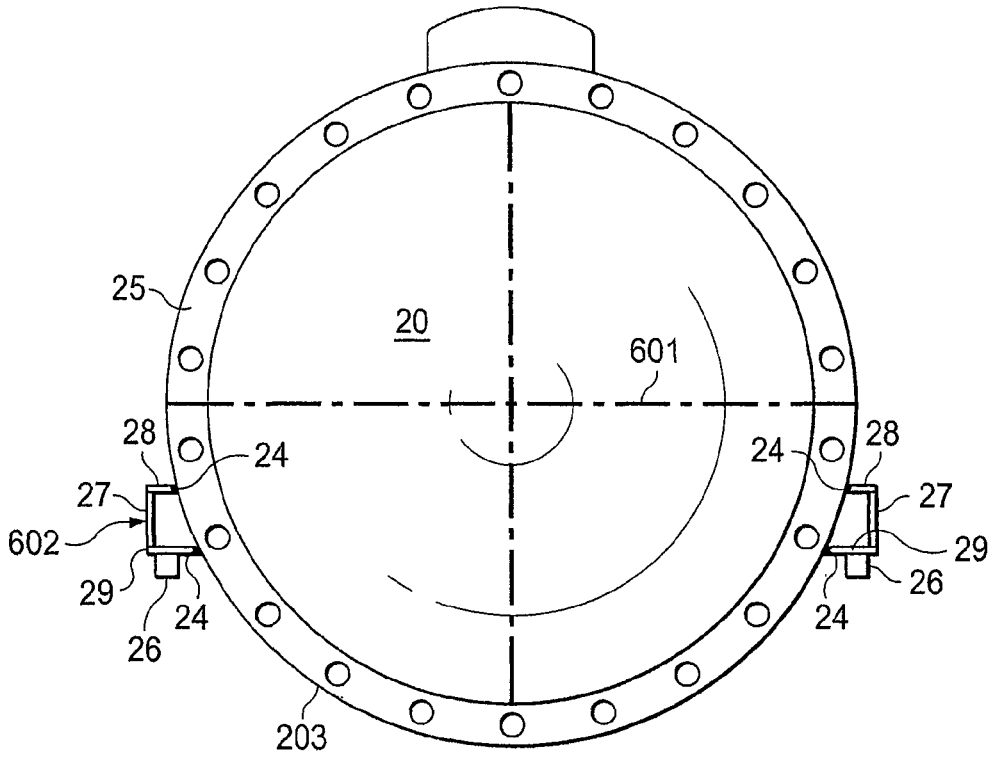
FIG. 6 shows one embodiment of a tank having pedestals constructed thereon.

Returning now to the concepts of the present invention, as shown in FIGS. 2, 2A, and 2B, tank 20 (shown standing alone in FIG. 6) is effectively resting on a series of support structures longitudinally distributed along the length of the ship's cargo hold as shown expanded in FIG. 3.

Figure 2C:
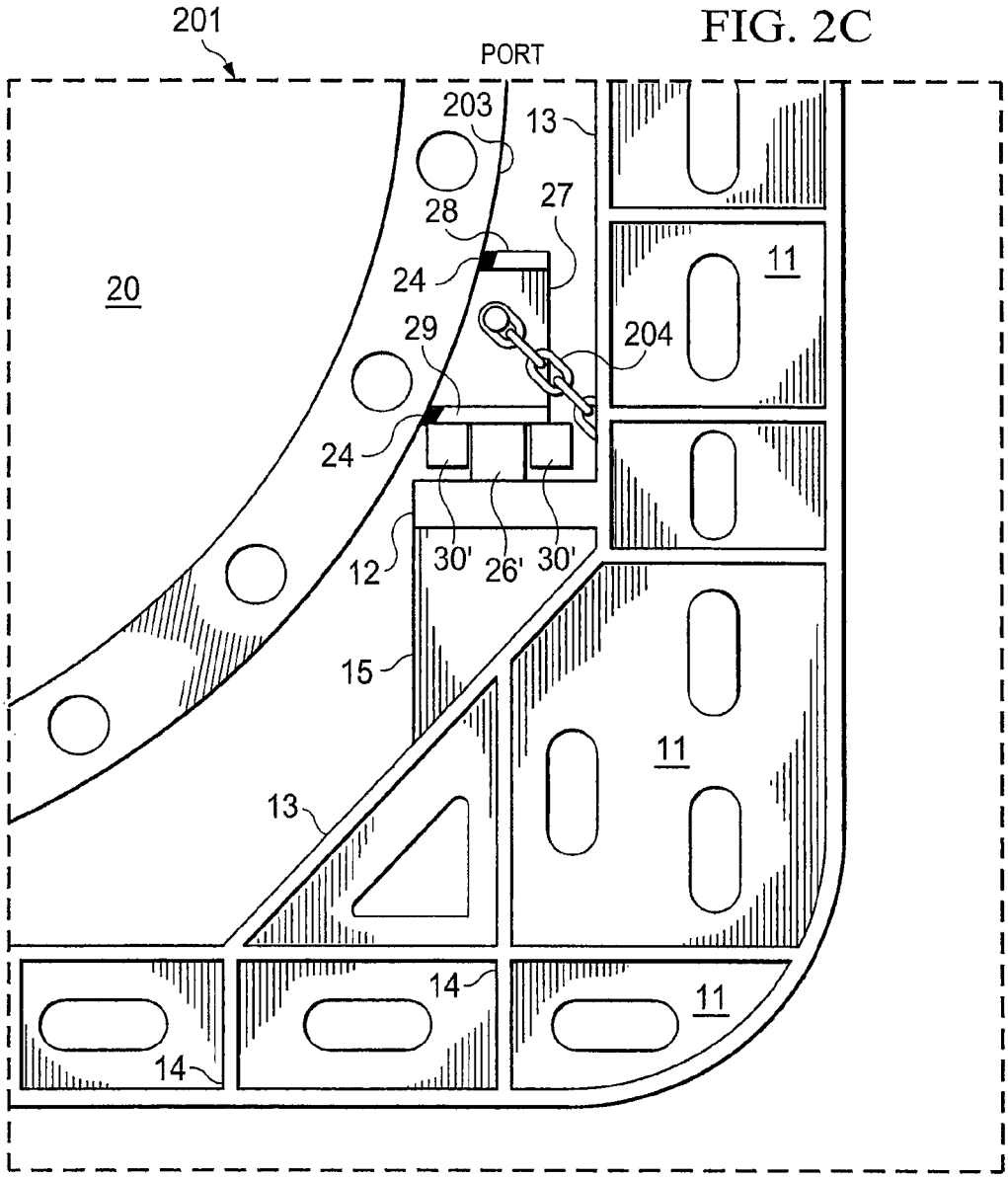
FIG. 2C shows an alternative embodiment of the pedestal.

In one embodiment, pedestals 26 are positioned under the bottom surface of tank support 27 at intervals along each side of the tank parallel to the tank's longitudinal axis. The pedestals are advantageously located in locations that correspond to the ship's webframing 11. While the preferred embodiment is that the pedestals are mounted to the tank, an alternate embodiment shown in FIG. 2C could position the pedestals 26' along the stringers so that they would mate with the longitudinal support 29 of the tank. In such an embodiment, the stops 30' can be on the tank support 29.

The ends of the tank may be hemispherical, Kloeber or other suitable types and need not be the same at both ends. The tank diameter may be 25 m or more. The cylinder length to diameter ratio of the tank is limited primarily by two factors. The first is the deformation of the hull side under hydrostatic and cargo tank loads and its influence on tank deformation. The hull deformation varies as the square of the distance between the cargo hold bulkheads. Therefore a shorter hold will result in considerably less hull deformation.

The second important length to diameter ratio factor is the limitation of sloshing loads. It is well known that transverse sloshing in a cylindrical tank has little effect on the total tank load. However, sloshing in the longitudinal direction in a cylindrical tank depends on several factors the most significant of which is the length of the tank relative to its diameter. Typically, Type C cylindrical tanks have length to diameter ratios up to 3:1 and utilize swash bulkheads near the ends of the tank attached to the saddle ring frame to reduce sloshing loads. However, with tank diameters above 15 m the use of swash bulkheads becomes a technical challenge. By limiting the cylinder length to diameter ratio to under 2:1 the longitudinal sloshing loads may be small enough to eliminate the need for swash bulkheads. For smaller diameter tanks, higher length to diameter ratios could be implemented in conjunction with one or more swash bulkheads.

The axis of the cylindrical cargo tank is oriented horizontally in the fore and aft longitudinal direction of the ship. As discussed, the tank is supported by pedestals 26 arrayed at intervals on both sides of the tank parallel to and somewhat below the tank's horizontal centerline axis (601 in FIG. 6). Pedestals 26 are constructed, in one embodiment, of impregnated laminated wood or other suitable thermal insulating and load bearing material and are fixed to tank lower longitudinal girder 29. The transverse and longitudinal stops and longitudinal stringer under the pedestals are abutted by bearing pads having a low coefficient of friction load bearing material. Vertical supports 27 provide stiffening between lower girder 29 and upper girder 28. In the embodiment shown, tank support 602 (FIG. 6) is welded to the sides of the tank by welds 24 at upper girder 28, lower girder 29 and at vertical stiffener 27. The pedestals transfer the weight and vertical loads of the tank and its cargo to the ship's structure by way of longitudinal stringer 12.

Similarly, the pedestals transfer the transverse and longitudinal loads of the tank and its cargo to stops 30 and 41 (seen in FIGS. 3 and 4, respectively) which are fixed to longitudinal stringer 12. The stops constrain movement of the pedestal in one direction but allow movement in another direction so as to accommodate the expected thermal expansion and contraction of the tank, the expected deflections of the tank and ship's structure and their interaction on one another. The stops incorporate bearing pads which have a surface with a low coefficient of friction such as impregnated wood, polished stainless steel, Teflon, or the like, to facilitate slip between pedestal and stop.

As discussed, the pedestals are fixed under lower longitudinal girder 29 which is welded 24 (or otherwise secured) to the outside of tank 20 as shown in FIGS. 2, 2A, 2B and 6. Girder 29 is designed to carry longitudinal and transverse loads from the tank into the pedestals. The lower girders on each side of the tank are located in a horizontal plane the height of which is somewhere between the bottom of tank shell 203 and its horizontal centerline axis. The height of the horizontal plane above the bottom is determined by calculating the height at which the lowest overall bending and shear stresses are imposed on the cylindrical tank. The height above bottom varies with the geometry of the tank and the forces imposed on it by the ship's motions. The height of lower longitudinal girder 29 is generally between 20% and 40% of the tank diameter above the tank bottom.

A smaller upper longitudinal girder 28 acts to stiffen the tank further and is welded 24 (or otherwise secured) to the outside of tank 20 as shown in FIGS. 2, 2A, 2B and 6. The upper and lower girders are connected by a series of external vertical stiffeners 27 positioned along the longitudinal axis of the tank at the location of the pedestals. The tank internal ring frame 25 at each pedestal acts as the primary structural member for transferring the transverse and vertical tank loads to the pedestals. Vertical stiffeners 27 transfer the vertical and transverse loads from ring frame 25 to the pedestals via lower longitudinal girder 29. The spacing of the pedestals and ring frames will generally coincide with the ship's transverse webframe spacing. The ring frames could be outside the tank in some situations, but as the beam of the ship is generally limited for a given cargo capacity, external ring frames would reduce the tank size and thus the cargo carrying capacity for a ship of a given beam.

As discussed, the ship's hull incorporates a longitudinal shelf or stringer 12 at the height of the bottom of the pedestals on each side of the hull. A bearing pad may be fitted between the stringer and pedestals. The stringers are supported by vertical frames 15 (FIGS. 2A and 2B) which distribute the vertical and transverse loads from the tank into the ship's webframes. The repetitive nature of the vertical and transverse supports distributes the tank loads fairly evenly into the hull structure. This permits a straight forward and simplified hull structural layout when compared with a Type C tank hull. The pedestals are positioned to be approximately level to each other and level with the ship's waterline. Note, the ring frames act to carry and distribute loads from the pedestals and permit the design of cargo tanks with diameters much larger than current marine practice.

The tank is fixed vertically downward and against rotational movement by the weight of the tank resting on pedestals 26 which are, in turn, supported by the ship's structure. In case of flooding of the hold, the tank is loosely held from floating up by chains 204 or similar hold down devices located at each pedestal or, if desired, at a minimum of four pedestals, two each side. Chains 204 or similar hold down devices could be attached to the longitudinal stringer 12, bulkhead 13 or similar location to achieve the same preventive purpose.

The transverse position is controlled by transverse stops 30, shown in FIG. 3, which are advantageously placed only on one side of the ship (the starboard side in the embodiment shown). This single side placement then allows the tank to expand and contract freely on the unconstrained side.

FIG. 3 shows transverse stops 30 at each pedestal 200 along the lateral length of tank 20. If the tank is transversely held only on one ship side then all of the transverse loads are transmitted into that side of the ship's hull. The unsupported tank side is free to move transversely and to accommodate deformation and thermal shrinkage.

If desired, it is possible to place transverse stops on both ship sides along the lateral length of the tank. Variations of this transverse stop system may, for example, be the use of transverse stops on both sides of the tank. In such case, the transverse loads can be more or less evenly transmitted into both ship sides. The following example variations can be foreseen:

a) One inboard transverse stop port and one inboard transverse stop starboard per pedestal;
b) Inboard and outboard stops port and one inboard stop starboard per pedestal; and
c) Inboard and outboard stops port and inboard and outboard stops starboard per pedestal.

In case c) one set of stops may be arranged for the inboard stop to be in contact with the pedestal in the "cold" tank condition and the outboard stop having contact with the pedestal in the "warm" tank condition, i.e., the stops are spaced so that the tank can expand and contract through thermal cycles without binding in the transverse stops. In another configuration, the just mentioned outboard transverse stop may be adjusted after the tank is cold to minimize the gap between pedestal and stop.

The ideal transverse stop design solution depends on numerous variables and may be different for each ship design depending on hull structure, tank size, liquefied gas density, pressure, etc.

Figure 4:
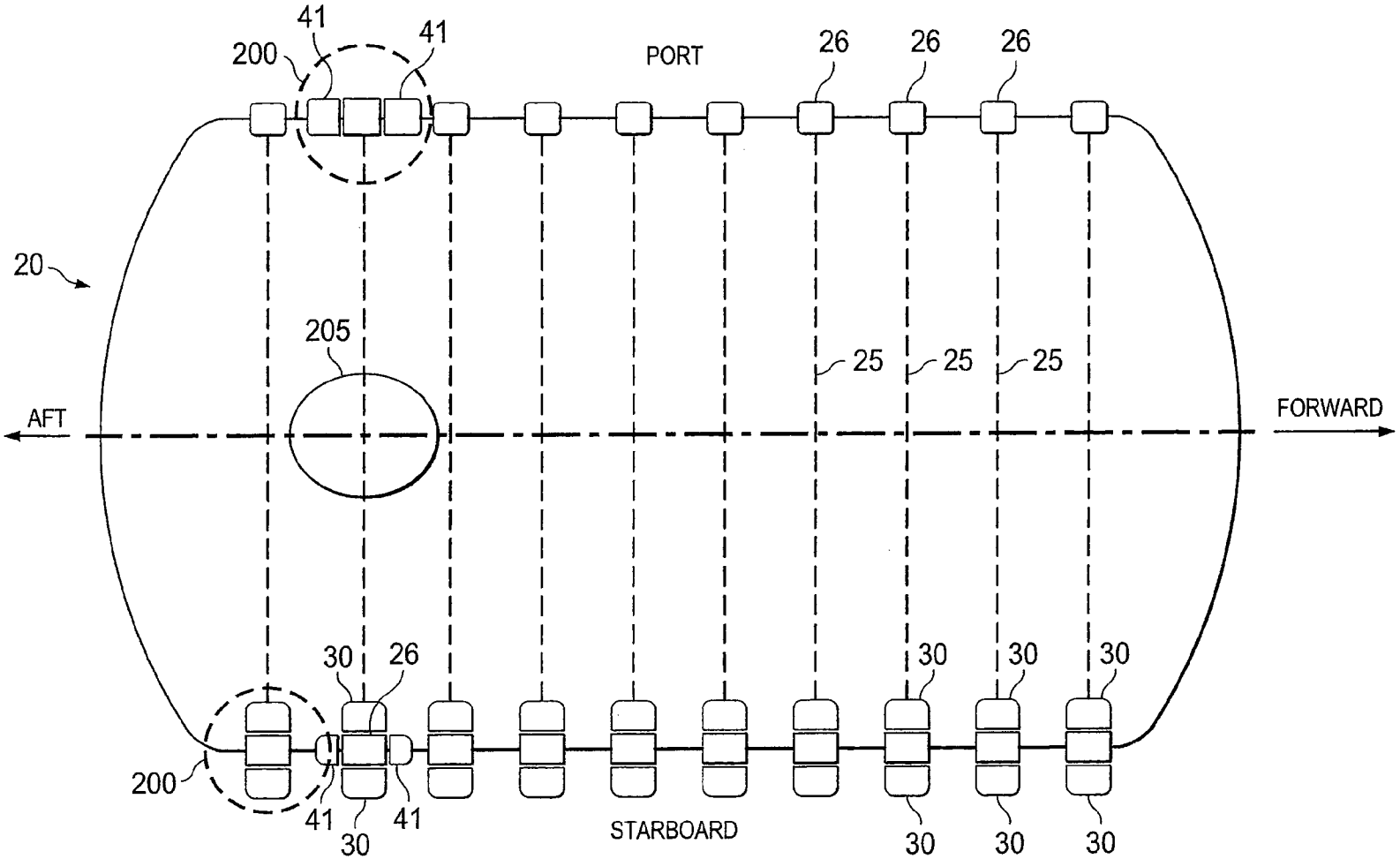

The longitudinal position is controlled by longitudinal stops 41, FIG. 4, which can be placed on the port and starboard side of the tank, as shown. The stops act on pedestals fixed to lower girder 29 and sized to accommodate the longitudinal loads in both the forward and aft direction. Only one set of stops port and starboard need be fitted and they are generally located port and starboard at the longitudinal location of tank dome 205 where the fill and discharge pipes are connected to the tank. This stop location allows the tank to expand and contract longitudinally away from the loading pipes (not shown) so as to maintain a fixed position between the tank pipes and the ship's structure. The aft end of the tank 32 is closest to the back end of the ship and forward end of the tank 31 is closest to the front end of the ship, as seen in FIG. 3. Tank dome 205 is a vertical cylindrical cupola mounted at the top of the cylindrical tank usually at the aft end. It acts as a liquid free vapor space for collection of vapors. Cargo tank piping, fill line, pump discharge, vapor line, etc. penetrate the tank through the dome.

The transverse stops permit movement of the tank in the longitudinal direction. The longitudinal stops permit movement only in the transverse direction. A gap may exist between the bearing pads mounted on the stops and the pedestals. The purpose of the longitudinal and transverse stops is to allow deflection of the tank and ship's hull without imposing undue stresses on one another. At some point the deflection of the tank and/or ship's structure becomes unwanted or unsafe and thus the system is designed to maintain the deflections within the acceptable limits and not require the tank or the ship to be overbuilt.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A cargo ship having at least one cargo tank positioned in a hold of said ship, said cargo ship comprising:

a cargo hold having two ends, two sides, a bottom and a top;

transverse and longitudinal structure members within said hold, said transverse members spaced at intervals within said cargo hold;

a cylindrical cargo tank with at least three pedestal pairs mated to an outside surface of said tank below a circumferential diameter of said tank; each said pedestal pair positioned on said tank at a location coincident with one of said transverse structural members;

longitudinal stringers on each side of said hold fixed to said transverse structural members and positioned to support said pedestals;

transverse stops fixed to said longitudinal stringers so as to constrain movement of said cargo tank pedestals in the transverse direction but not in the longitudinal direction;

longitudinal stops at one axial location so as to constrain said pedestals in said longitudinal direction but not said transverse direction; and a plurality of hold-down devices affixed to transverse structural members so as to keep said tank from floating upward away from said bottom should said cargo hold be flooded.

2. The ship of claim 1 wherein liquefied gases may be stored in said tank and transported under pressure and at cryogenic temperatures.

3. The ship of claim 1 wherein liquids may be stored in said tank and transported under pressure and above ambient temperatures.

4. The ship of claim 1 wherein length to diameter of said cargo tank is configured to eliminate harmful effects of sloshing without a need for special provisions within the cargo tank.

5. The ship of claim 1 wherein said transverse and longitudinal stops and longitudinal stringer under the pedestals are abutted by bearing pads having a low coefficient of friction load bearing material.

6. The ship of claim 1 wherein said longitudinal stringers stiffen said ship's sides thereby reducing transverse deflection of said cargo hold sides.

7. The ship of claim 1 wherein said transverse structural members distribute vertical and transverse loads from said cargo tank pedestals.

8. The ship of claim 1 wherein said transverse and lateral stops are separate from said pedestals and spaced to allow limited movement of said pedestals between said stops in order to maintain cargo tank stresses within safe levels.

9. The ship of claim 1 wherein said hold-down devices are located at four or more pedestals and prevent said cargo tank from floating up more than a predetermined amount.

10. A cargo tank support system for use in a cargo ship, said system comprising:

a cylindrical cargo tank with its longitudinal axis arranged roughly parallel to the longitudinal axis of said ship;

for each cargo tank, a plurality of pedestals positioned along both sides of said cargo tank in an array parallel to said cargo tank longitudinal axis and positioned to correspond to webframing of said cargo ship;

said pedestals each constrained from moving downward toward a bottom of said ship by structural elements fixed to said ship's hull;

at least certain of said pedestals operative in conjunction with a first set of stops positioned parallel to said longitudinal axis and in association with said pedestals to constrain said cargo tank in a transverse direction; and at least certain of said pedestals operative in conjunction with a second set of stops positioned parallel to said longitudinal axis and in association with said pedestals to constrain said cargo tank in a longitudinal direction, said first and second stops being structurally independent from said pedestals, wherein said pedestals are permanently attached to said structural elements and said stops are permanently attached to said tank.

* * * * *